United States Patent [19]

Rhodes, Jr.

[11] Patent Number: 5,067,476

[45] Date of Patent: Nov. 26, 1991

[54] ARTIFICIAL LOG ASSEMBLY INCLUDING COMBUSTABLE LOG MEMBERS

[75] Inventor: Robert T. Rhodes, Jr., Peru, Ind.

[73] Assignee: Majco Building Specialties, L.P., Huntington, Ind.

[21] Appl. No.: 561,874

[22] Filed: Aug. 2, 1990

[51] Int. Cl.[5] ..... F23H 13/00

[52] U.S. Cl. ..... 126/540; 126/543; 126/555; 126/152 B; 431/125

[58] Field of Search ..... 126/540, 555, 543, 152 B; 431/125

[56] References Cited

U.S. PATENT DOCUMENTS

| | | | |
|---|---|---|---|
| 613,015 | 10/1898 | Monroe | 431/125 |
| 1,017,751 | 2/1912 | Hansen . | |
| 1,189,389 | 7/1916 | Ryan | 126/555 X |
| 3,543,741 | 12/1970 | Whitehead | 431/125 |
| 3,583,845 | 6/1971 | Pulone . | |
| 3,993,430 | 11/1976 | Forker . | |
| 4,076,490 | 2/1978 | Hilker . | |
| 4,573,905 | 3/1986 | Meyers . | |
| 4,582,478 | 4/1986 | Hilker | 431/125 |
| 4,838,240 | 6/1989 | Rieger | 431/125 |
| 4,838,781 | 6/1989 | Fischer . | |
| 4,886,445 | 12/1989 | Richardson | 431/125 |

FOREIGN PATENT DOCUMENTS

| | | | |
|---|---|---|---|
| 2182431 | 5/1987 | United Kingdom | 431/125 |

*Primary Examiner*—Larry Jones

*Attorney, Agent, or Firm*—Hoffmann & Baron

[57] ABSTRACT

An artificial log assembly is provided which produces a realistic looking flame resembling that of a natural wood log fire. The assembly includes a grate, cement logs positioned upon the grate, and a combustible log made from wax or other clean burning material positioned among the cement logs. The grate includes steps which allows the artificial logs to be positioned in such a manner that they resemble a stack of natural wood logs. One or more cement logs extend over the combustible log to deflect the flame generated thereby. An ash pan is removably positioned beneath the grate for trapping the ash generated by the combustible log.

20 Claims, 2 Drawing Sheets

ARTIFICIAL LOG ASSEMBLY INCLUDING COMBUSTABLE LOG MEMBERS

BACKGROUND OF THE INVENTION

1. Field of the invention

The field of the invention relates to artificial log assemblies including combustible and non-combustible log members.

2. Brief description of the related art

Fireplaces are employed in residences for the provision of heat and for aesthetic purposes. A growing awareness of the environmental problems associated with burning wood has led to various alternatives for producing a natural looking flame.

Natural gas is often employed in conjunction with ceramic or other non-combustible log members for providing an aesthetically pleasing flame. Assemblies have also been provided which include containers of liquid fuel mounted beneath and/or behind simulated logs.

Various artificial, combustible log products are also available for use in fireplaces. Such products may be made from paraffin wax or other materials or combinations thereof. They do not, by themselves, produce flames which look realistic. If too many of such log products are burned at the same time within a manufactured fireplace, there is a possibility of the fireplace overheating. It would accordingly be desirable if a system were designed which permitted the burning of only a selected number of such log products at a time while providing the consumer with a natural looking flame.

SUMMARY OF THE INVENTION

It is an object of the invention to provide an assembly which is capable of producing a flame resembling that produced by the burning of wood logs, without burning such logs.

It is another object of the invention to provide an assembly which provides a natural looking flame without the work, mess and pollution associated with the burning of wood.

A still further object of the invention is to provide an assembly which limits the space available for combustible, artificial logs so that too many of such logs cannot be used in a firebox at any given time.

In accordance with these and other objects of the invention, an assembly is provided which includes a grate, first and second non-combustible log members supported by the grate, and a combustible log member positioned between and adjoining the non-combustible log members. The combustible log member is preferably comprised of a material which burns cleanly. The grate may be stepped or otherwise constructed so that the combustible log member is positioned behind and above the first non-combustible log member while the second non-combustible log member is positioned above and behind the combustible log member. The flame generated by the combustible log member or members will accordingly resemble that generated by a pile of burning wood logs.

In accordance with a second embodiment of the invention, an assembly is provided which includes a grate, a first set of non-combustible log members supported by the grate and extending transversely with respect to the grate, at least one combustible log member supported by the grate and extending transversely with respect to the grate, and at least one non-combustible log member at least partially supported by the first set of non-combustible log members and spanning the combustible log member, the at least one non-combustible log member being positioned to deflect any flame generated by the combustible log member in at least two directions.

DETAILED DESCRIPTION OF THE INVENTION

Figure 1:
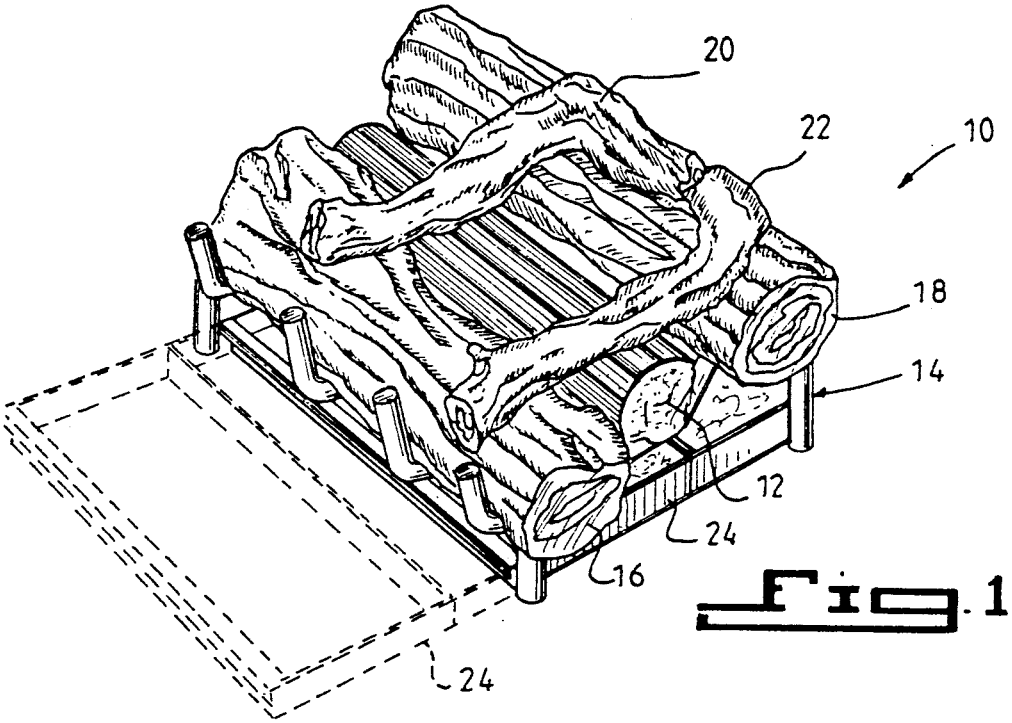
FIG. 1 is a top perspective view of a log member assembly according to the invention.

An assembly 10 for producing a natural looking flame through the use of a single combustible log member 12 is shown in FIG. 1. The assembly includes a grate 14, non-combustible log members 16, 18, 20, 22, the combustible log member 12, and an ash pan 24.

The non-combustible log members are made from cement or any other suitable material which may be cast or otherwise formed into structures resembling wood logs. They are preferably made from a high temperature refractory mixture that is steel reinforced to allow them to be supported at their ends. First and second non-combustible log members 16, 18 extend transversely with respect to the grate. They are positioned such that a space is left therebetween for one and only one combustible log member 12. Third and fourth non-combustible log members 20, 22 are supported by the first and second such members 16, 18, and extend generally perpendicularly with respect thereto. These members 20, 22 extend over the combustible log 12, thereby deflecting the flames projecting therefrom. This helps provide a more realistic appearance.

Figure 2:
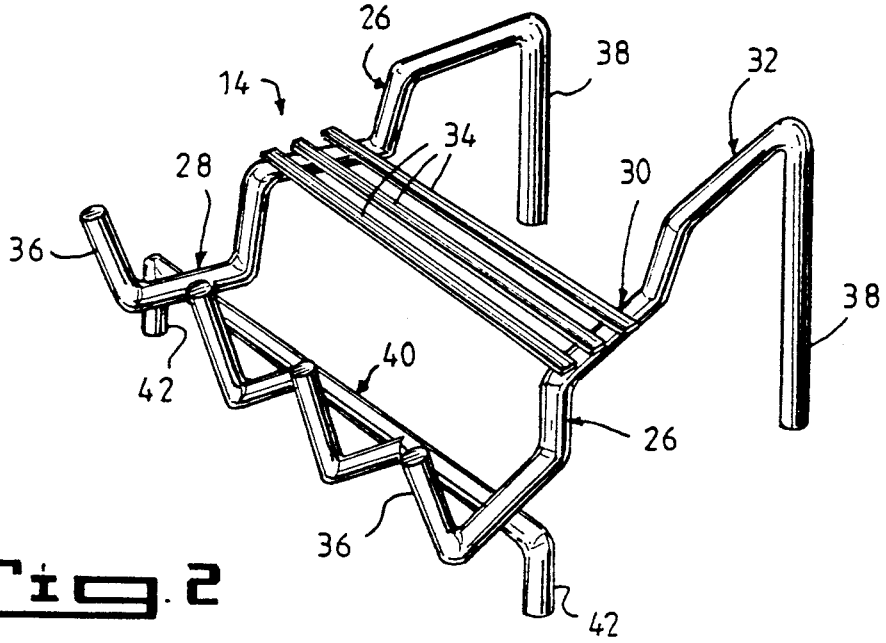
FIG. 2 is a top perspective view of a grate employed in accordance with the invention.

The grate 14 is best shown in FIG. 2. It includes a pair of substantially identical side rails 26 in opposing relation with respect to each other. The side rails include substantially horizontal portions defining first, second and third steps 28, 30, 32. The first non-combustible log member 16 is supported by the first step 28 while the second non-combustible log member is supported by the third step 32.

A plurality of transverse bars 34 are secured to horizontal portions of the side rails 26 which define the second step 30 of the grate 14. The combustible log member 12 is supported by the second step of the grate 14. As this log member burns, the bars 34 prevent it from breaking apart and falling through between the side rails 26. Since the cement log members 16, 18 do not burn, comparable support bars are not necessary for the first and third steps.

The grate 14 may be made from one half inch round bar stock which is welded together at the appropriate locations. It may be made from smaller or larger diameter stock depending upon the size and weight of the logs which require support. Square or rectangular stock could alternatively be employed.

The support surface for the combustible log member 12 is constructed to allow ash generated thereby to fall downwardly into the ash pan 24. A grid (not shown)

may be employed in place of the transverse bars 34 if desired.

The front end portion 36 of each side rail 26 extends generally upwardly with respect to the first step 28 of the grate 14. These end portions help maintain the first non-combustible log member 16 in a fixed position. The rear end portion of each side rail 26 extends downwardly with respect to the third step 32. These rear end portions define the rear legs 38 of the grate 14.

A U-shaped support 40 is secured to the grate 14 beneath the first step 28 thereof. This support 40 includes a transverse bar secured to the side rails and a pair of downwardly extending legs 42. A pair of L-shaped projections extend forwardly from the transverse bar and provide the same function as the front end portions 36 of the side rails 26.

Figure 3:
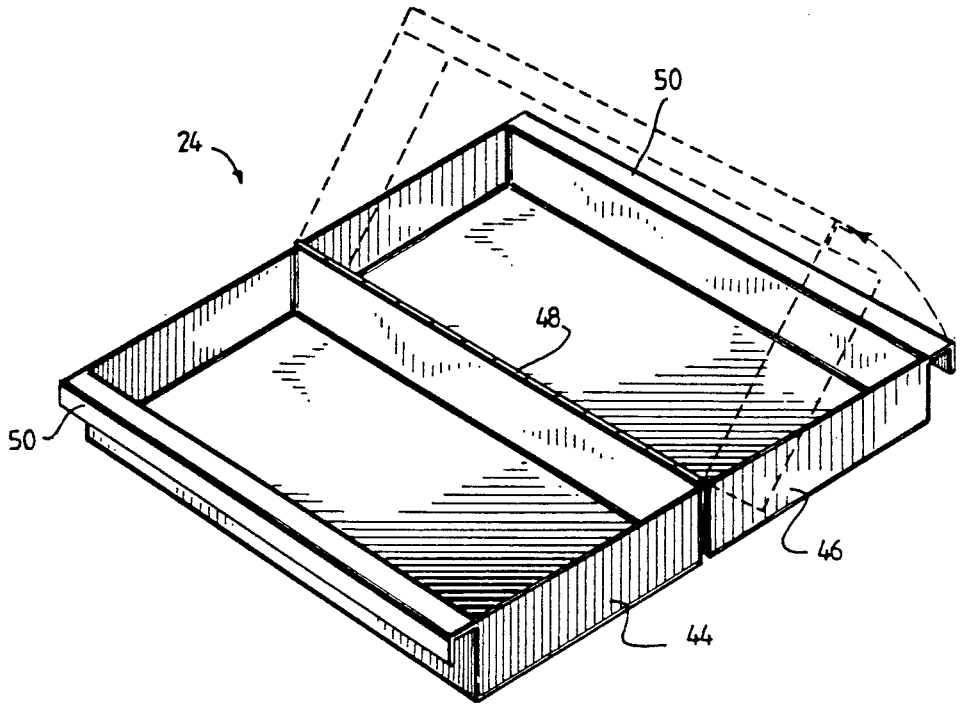
FIG. 3 is a top perspective view of an ash pan employed in accordance with the invention.
Figure 4:
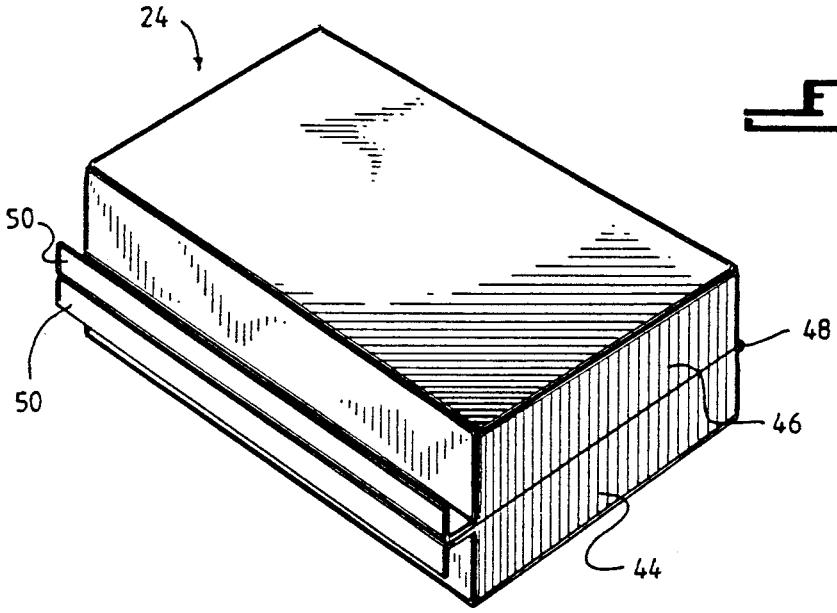
FIG. 4 is a top perspective view of the ash pan of FIG. 3 in the closed position.

The ash pan 24 is shown in the open and closed positions in FIGS. 3 and 4, respectively. It includes first and second flat pans 44, 46 which are secured to each other by a transverse hinge 48. Each pan 44, 46 is substantially identical in configuration. A handle 50 is secured to each pan for allowing the ash pan 24 to be easily removed from beneath the grate 14. As shown in FIG. 4, the handles 50 adjoin each other when the ash pan is in the closed position. The ash pan may accordingly be carried in the closed position from the assembly by holding the adjoining handles.

In use, the combustible log member 12 is positioned upon the transverse bars 34. It is preferably positioned between the first and second non-combustible log members 16, 18 so that it is partially hidden from view by the first such member 16. The space created between the first and second non-combustible log members, and between the transverse bars 34 and the overlapping log members 20, 22, is sufficient to accommodate one combustible log member 12. The length of the combustible log member is roughly the same as the lengths of the first and second non-combustible log members. Its average diameter may also approximate those of the two adjoining log members or be somewhat smaller, as shown. If insertion of a single combustible log member into the space defined by the non-combustible log members would be difficult, two combustible log members having half the length of the transverse log members 16, 18 can be inserted, respectively, from opposite sides of the assembly.

Once ignited, the combustible log 12 provides a flame which appears to be emanating from the middle of a stack of logs. The log members 20, 22 spanning the combustible log member each deflect the flame generated by the combustible log in two directions, thereby creating an uneven flame which is more realistic. Ash from the combustible log member 12 falls between and outside of the transverse bars 34 which support it. These bars allow the combustible log member to maintain its integrity substantially throughout the duration of the fire. Once the fire is extinguished, the ash pan 24 may be removed, emptied and replaced.

The combustible log member is preferably composed primarily of a petroleum wax or mixture of waxes which may be mixed with a cellulosic material. Such products are commercially available and need not be described in great detail. The assembly according to the invention provides a realistic fire through the use of only one such combustible log member. The possibility of overheating a firebox in which the assembly 10 is placed is thereby avoided.

It will be appreciated that larger fireplaces (not shown) may include non-combustible log assemblies capable of accommodating more than one combustible log member. The combustible logs would be arranged in alternating sequence with the non-combustible logs, and spanning logs would be used to deflect the flames. The non-combustible log members may also be manufactured as individual pieces or as an integral assembly.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for providing a natural looking fire within a fireplace or the like, comprising:

a grate;

first and second non-combustible log members supported by said grate and extending transversely with respect to said grate, and a combustible log member positioned between and adjoining said first and second non-combustible log members, said combustible log member extending transversely with respect to said grate.

2. An assembly as described in claim 1 wherein said combustible log member is comprised at least partially of wax.

3. An assembly as described in claim 1 wherein said combustible log member is positioned behind and extends at least partially above said first non-combustible log member, said second non-combustible log member being positioned behind and at least partially above said combustible log member.

4. An assembly as described in claim 3 wherein said grate includes first and second side rails, said side rails being in opposing relation to each other and defining first, second and third steps, said first non-combustible log member being supported by said first step, said combustible log member being supported by said second step, and said second non-combustible log member being supported by said third step.

5. An assembly as described in claim 4 including support means extending transversely between said first and second side rails and defining a support surface for said combustible log member.

6. An assembly as described in claim 5 wherein said support means includes a plurality of grate bars secured to said first and second side rails.

7. An assembly as described in claim 6 including at least one non-combustible log member supported by said first and second non-combustible log members and extending over said combustible log member.

8. An assembly as described in claim 6 wherein said side rails each include a first end portion extending upwardly with respect to said first step.

9. An assembly as described in claim 8 wherein each of said side rails includes a second end portion extending downwardly with respect to said third step.

10. An assembly as described in claim 9 including a generally U-shaped support secured to said first step, said U-shaped support including a pair of leg members extending downwardly with respect to said first step.

11. An assembly for providing a natural looking fire within a fireplace or the like, comprising:

a grate;

a first set of non-combustible log members supported by said grate and extending transversely with respect to said grate;

at least one combustible log member supported by said grate and extending transversely with respect to said grate;

at least one non-combustible log member at least partially supported by said first set of non-combustible log members and spanning said combustible log member.

12. An assembly as described in claim 11 including a plurality of non-combustible log members supported by said first set of non-combustible log members and spanning said combustible log member.

13. An assembly as described in claim 12 wherein said combustible log member is positioned between a pair of transversely extending, non-combustible log members.

14. An assembly as described in claim 13 wherein said combustible log member is positioned at a higher elevation than one of said pair of transversely extending, non-combustible log members and at a lower elevation than the other of said transversely extending, non-combustible log members.

15. An assembly as described in claim 14 wherein said grate includes means for supporting the entire length of said combustible log member.

16. An assembly for providing a natural looking fire within a fireplace or the like, comprising:

a grate;

an ash pan positioned beneath said grate;

first and second non-combustible log members supported by said grate and extending transversely with respect to said grate; and a combustible log member positioned between and adjoining said first and second non-combustible log members, said combustible log member extending transversely with respect to said grate.

17. An assembly as described in claim 16 wherein said ash pan includes a substantially flat pan and a cover hingedly secured to said pan.

18. An assembly as described in claim 17 wherein said cover is a flat pan.

19. An assembly as described in claim 18 wherein each of said flat pans defining said ash pan includes a handle extending from an end surface thereof.

20. An assembly as described in claim 1 including a plurality of non-combustible log members supported by at least one of said first and second non-combustible log members and extending over said combustible log member.

* * * * *